US007644742B2

(12) United States Patent
Burkholder

(10) Patent No.: US 7,644,742 B2
(45) Date of Patent: Jan. 12, 2010

(54) WOODWORKING MACHINE FOR SHAPING MOLDING

(76) Inventor: Leon R. Burkholder, 25530 CR. 42, Nappanee, IN (US) 46550

( * ) Notice: Subject to any disclaimer, the term of this patent is extended or adjusted under 35 U.S.C. 154(b) by 375 days.

(21) Appl. No.: 11/812,379

(22) Filed: Jun. 18, 2007

(65) Prior Publication Data

US 2008/0017274 A1 Jan. 24, 2008

Related U.S. Application Data

(60) Provisional application No. 60/831,617, filed on Jul. 19, 2006.

(51) Int. Cl.
*B27C 5/02* (2006.01)

(52) U.S. Cl. ..... 144/134.1; 144/203; 901/31

(58) Field of Classification Search ..... 144/1.1, 144/2.1, 3.1, 24.02, 41, 82, 134.1, 382, 386, 144/388, 391, 394, 430
See application file for complete search history.

(56) References Cited

U.S. PATENT DOCUMENTS 1,352,620 A * 9/1920 Onsrud ..... 144/204
1,844,069 A * 2/1932 Mattison ..... 144/243
2,616,459 A 11/1952 Johnson
3,323,564 A * 6/1967 Froehlich ..... 144/386
3,754,583 A 8/1973 Ingram
3,838,723 A * 10/1974 Sandberg ..... 144/133.1
4,326,572 A 4/1982 Ingram et al.
4,429,726 A 2/1984 Betzler
4,842,029 A 6/1989 De Abreu
5,161,589 A * 11/1992 DeBiagio ..... 144/134.1
5,463,835 A 11/1995 Wood
5,509,707 A * 4/1996 Schauer ..... 294/86.4
5,680,888 A 10/1997 St-Pierre et al.
5,979,038 A 11/1999 Nelson et al.
6,076,574 A 6/2000 Fadyk
6,502,002 B2 12/2002 Susnjara et al.

FOREIGN PATENT DOCUMENTS

JP 6293003 10/1994

* cited by examiner

*Primary Examiner*—Dana Ross
*Assistant Examiner*—Jennifer Chiang
(74) *Attorney, Agent, or Firm*—Richard C. Litman

(57) ABSTRACT

The woodworking machine for shaping molding has a hollow cylindrical cartridge with end caps having openings defined therein adapted for inserting a blank strip of molding through the cartridge. Robotic grippers advance the molding strip through the cartridge in indexed increments. A cutter assembly is mounted on a movable table, the cutter assembly having a plurality of spaced apart cutters. An electronic control system, preferably including a programmable logic controller, causes the grippers to grip the blank molding, insert the blank through the cartridge, actuate the cutter assembly and move the table so that the cutters simultaneously cut a plurality of notches in the molding, retract the cutter assembly, advance the molding the indexed distance, and automatically repeat the cycle, ejecting the strip when notches have been formed in the entire length of the molding. The machine may be used to form dental molding.

20 Claims, 11 Drawing Sheets

WOODWORKING MACHINE FOR SHAPING MOLDING

CROSS-REFERENCE TO RELATED APPLICATION

This application claims the benefit of U.S. Provisional Patent Application Ser. No. 60/831,617, filed Jul. 19, 2006.

BACKGROUND OF THE INVENTION

1. Field of the Invention

The present invention relates to woodworking machines, and particularly to a woodworking machine for shaping molding that is automated for high speed and production. The woodworking machine is particularly well adapted for the high speed production of a type of molding known in the trade as dental molding for decoration of buildings, furniture, etc.

2. Description of the Related Art

Dental molding is a type of molding used in the construction, furniture making, and woodworking industries. As with any type of molding, dental molding can be used to cover joints and for decorative purposes, such as ornamentation on the exterior surfaces of a building, e.g., at the cornice, and for covering the rough edges of plywood, particle board, and other boards used in woodworking for shelves, cabinets, and the like, and for many other applications.

Dental molding is typically formed from blank molding strips furnished by lumber mills in various lengths, e.g., ten to sixteen feet, and in square or rectangular cross section from ¼"×¼" to 1"×1". These dimensions are given for exemplary purposes only, and it should be understood that dental moldings are manufactured in a wide range of sizes. Notches of uniform depth are cut into at least one side of the blank at equally spaced distances to form teeth or dental blocks. The notches may be cut into one or two sides of the blank molding to form different decorative effects. Typically the location of the teeth are manually marked on the blank strip of molding, and the notches are cut one at a time by a table saw, radial saw, or the like equipped with a dado blade, or by a router equipped with an appropriate dado bit.

This process is, however, very labor intensive, and requires a fair amount of skill to keep the spacing and depth of the notches uniform. When the strip is to be cut into shorter lengths, a great deal of planning is required to space the notches properly to allow for the crosscut that will separate the blank strip into shorter lengths. While this process may be manageable for the isolated odd job, it would be desirable to have an automated machine that can produce a volume of strips of ornamental molding, particularly dental molding, quickly for preparing stocks of pre-formed molding for sale at hardware stores, lumber yards, and the like Thus, a woodworking machine for shaping molding solving the aforementioned problems is desired.

SUMMARY OF THE INVENTION

The woodworking machine for shaping molding is an automated woodworking machine for the high-speed production of dental moldings and the like. The machine includes a substantially cylindrical cartridge assembly, which is hollow and defines an open interior region therein. The cartridge extends along a longitudinal axis. An outer portion of the cylindrical cartridge is preferably formed from a plastic material, and an air bag is disposed within the cylindrical cartridge in the open interior region. A blank strip of molding is inserted into the open interior region of the cartridge assembly, and a cutter assembly cuts a plurality of notches in both the cylindrical cartridge assembly and the workpiece to form the dental molding. The air bag, under external control, stabilizes the wooden block within the passage, and is in communication with an external source of compressed air.

The cutter assembly has a plurality of rotary cutters and is positioned on a movable table, which, under external control, automatically moves towards the cylindrical cartridge assembly to engage the cartridge assembly and the workpiece. Further, under external automatic control, the cartridge assembly may be rotated about the longitudinal axis thereof. Preferably, a pneumatic arm is joined to both a structural frame of the woodworking machine and to the cylindrical cartridge assembly for controlled rotation thereof.

Once the dental molding has been formed, the dental molding is automatically ejected from the cartridge assembly, and another workpiece may be inserted therein. A different cartridge is used for blank moldings of different cross-sectional size. Used cartridge assemblies may be removed and replaced, and the insertion of the workpieces is performed by an automatic robotic gripping mechanism, which is preferably a pneumatic system and is under external automatic control.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 9:
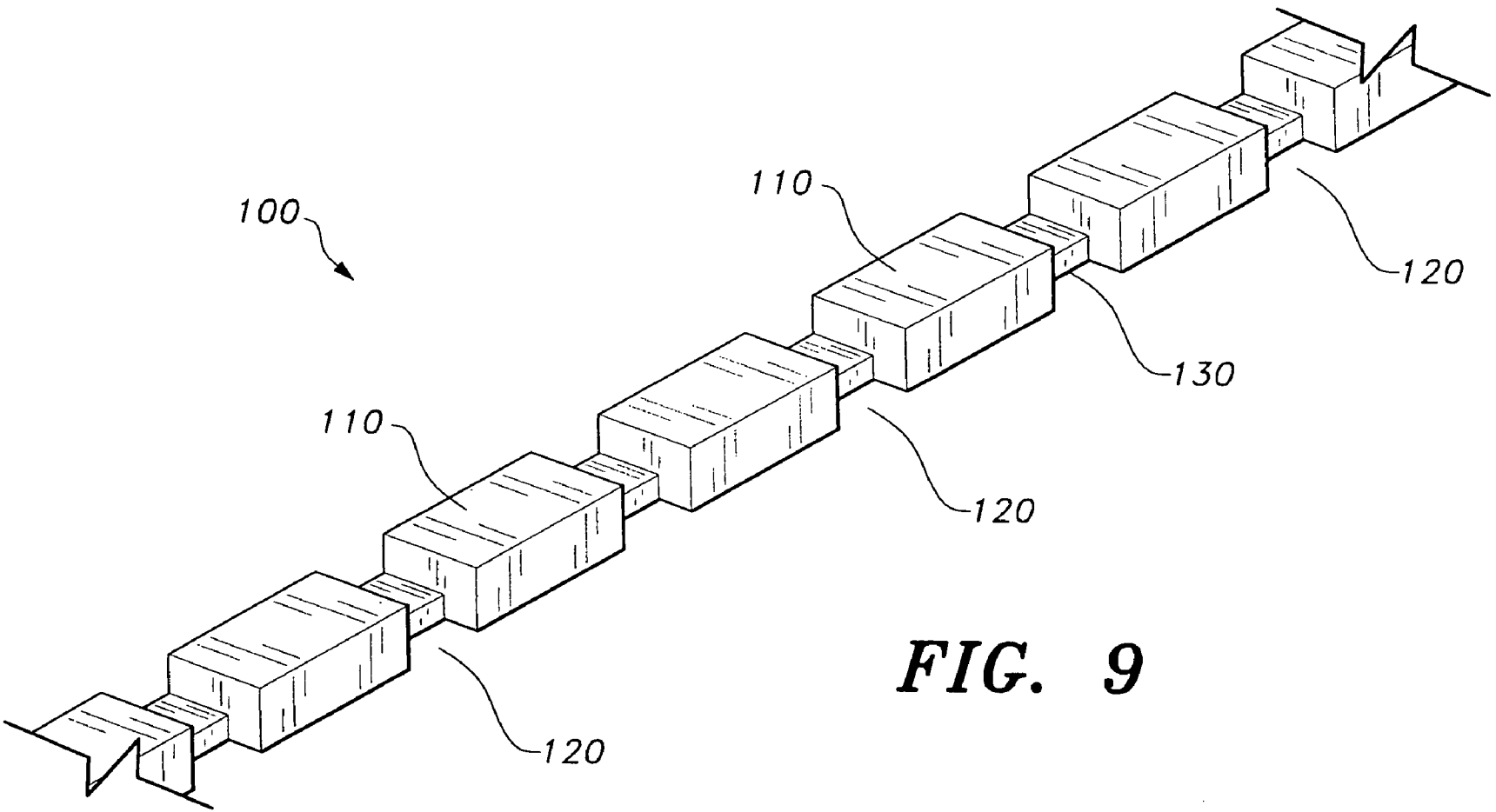
FIG. 9 is a perspective view of an exemplary dental molding produced by the woodworking machine for shaping molding according to the present invention.

The present invention is directed towards a woodworking machine for shaping molding, generally denoted as 10 in the drawings. An exemplary dental molding 100 that can be formed by the machine 10 is illustrated in FIG. 9. Moldings of the type shown in FIG. 9 are commonly referred to as "dental moldings". Typically, dental moldings are elongated members that may be used in building construction for decorative purposes in furniture and cabinet making, in woodworking, and the like. Dental moldings, such as dental molding 100, may be formed from wood or similar materials. The molding 100 is formed by shaping an elongated strip of blank molding that is square or rectangular in cross section by cutting notches in one or more sides of the feedstock in order to form teeth 110 spaced apart by the notches 120.

The teeth 110, notches 120 and connecting links 130 of the molding 100 may have any customized dimension and configuration. The exemplary molding 100 of FIG. 9 was formed by cutting notches in two sides of the blank molding. However, notches 120 can be cut into only one side of the molding blank to form a different ornamental effect, if desired. Preferably, each tooth 110 is substantially identical in size and contour to the adjacent teeth 110, and, further, each notch 120 is of a uniform size. It should be understood that dental molding 100 is shown for exemplary purposes only, and the contouring and size of teeth 110 and notches 120 may have a different configuration from that shown in the drawing. For example, the teeth 110 shown in the drawing have orthogonal side faces. However, the machine 10 may be configured to cut the teeth with angled, sloping lateral faces connected to the links 130, or with arcuate faces, if desired.

Machine 10, illustrated pictorially in FIGS. 1-8, is an automated device for the production of dental moldings, such as the exemplary dental molding 100. In use, a workpiece or blank stock elongated strip of square or rectangular molding is fed into machine 10 (from the right in FIGS. 1 and 7) to be gripped by a robotic gripper mechanism 24. An external guide may be optionally utilized prior to gripping mechanism 24 grasping the stock workpiece. The stock is typically an elongated strip of molding having a square or rectangular cross-sectional contour. Typical moldings are approximately eight to sixteen feet in length, although the dimension and configuration of the stock may vary, depending upon the source and type of lumber. The gripping mechanism 24 is, in the preferred embodiment, a robotic gripper operated under external automatic control. One such exemplary robotic gripper is the RP-35P, manufactured by Robohand®, Inc.

Figure 10:
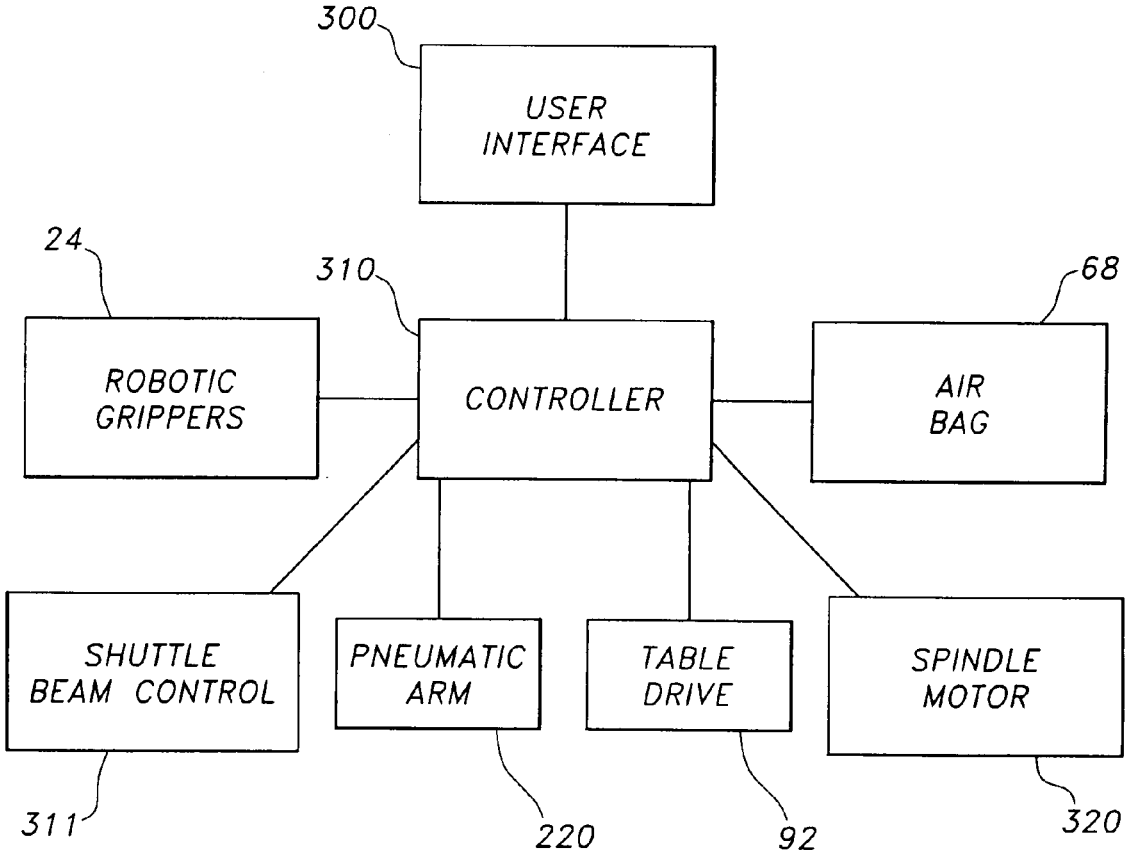
FIG. 10 is a block diagram of an electronic control system for a woodworking machine for shaping molding according to the present invention.
Figure 11:
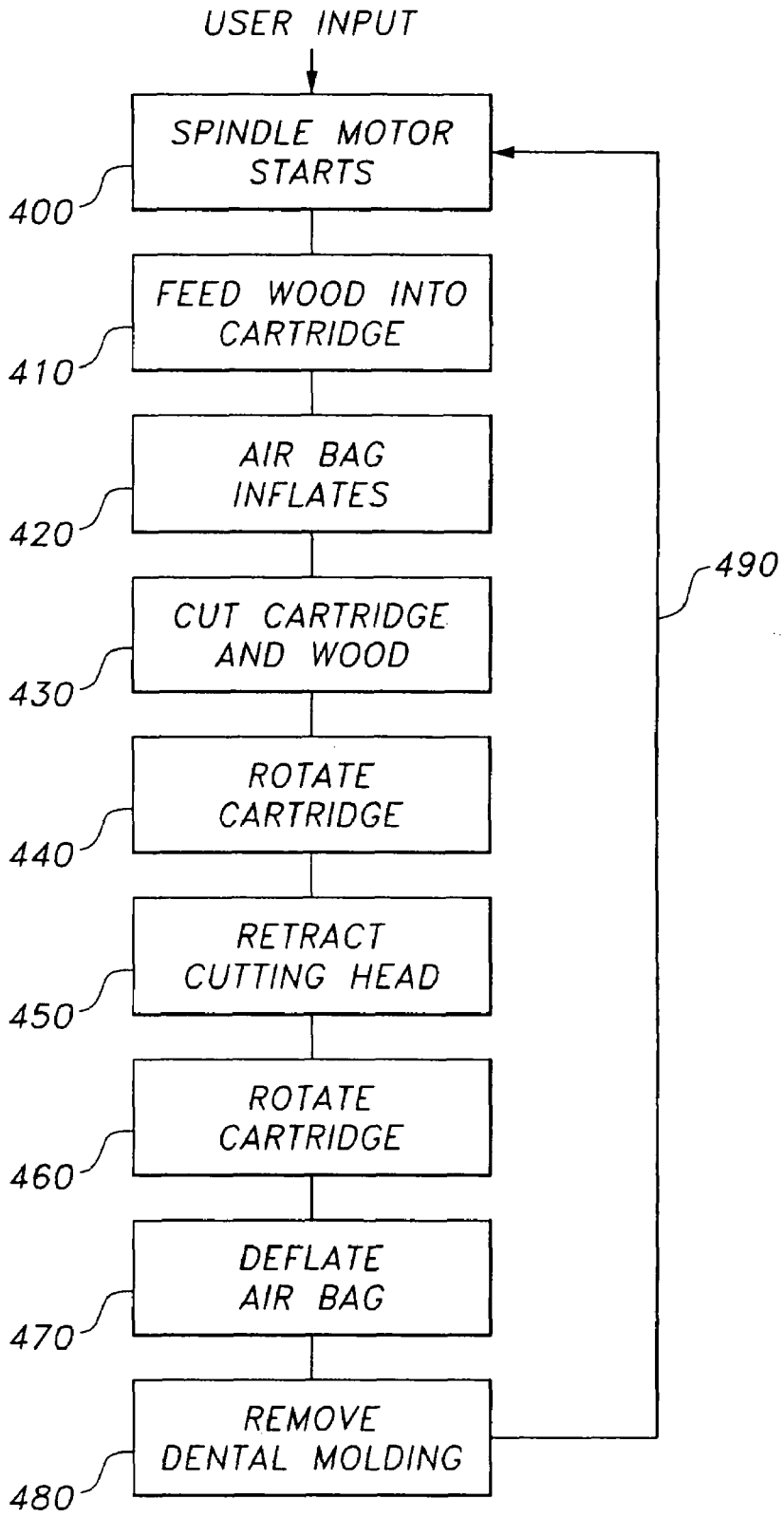
FIG. 11 is a flowchart of the steps executed by a woodworking machine for shaping molding according to the present invention during each cutting cycle.

Upon initiation of the production cycle, the user enters input parameters to machine 10 via a user interface 300 (shown in the block diagram of FIG. 10), which may be a control panel, keyboard or the like. The input may include parameters for the particular molding 100 to be formed, initiation codes or the like. The user input is fed into a programmable logic controller (PLC) 310, which may be in the form of a computer, processor, or the like. Upon initiation of the production process, a spindle motor 320 (to be described in detail below) is actuated to generate rotation in a cutting head. Actuation of the spindle motor is designated as step 400 in the flowchart of FIG. 11.

A second gripping mechanism 24 may be positioned adjacent the opposite end of the cartridge 26 (to be described in detail below) for removing the dental molding 100 once it has been fully formed, as well as for advancing the molding incrementally through the machine 10 between cutting cycles. Referring back to FIG. 1, the gripping mechanisms 24 are mounted on a shuttle beam 22, which further supports a pneumatic cylinder 20, providing a pressurized driving source for gripping mechanisms 24. The first gripping mechanism 24, after grasping the stock, feeds the stock into a cartridge assembly 26 (step 410 in FIG. 11).

Figure 4:
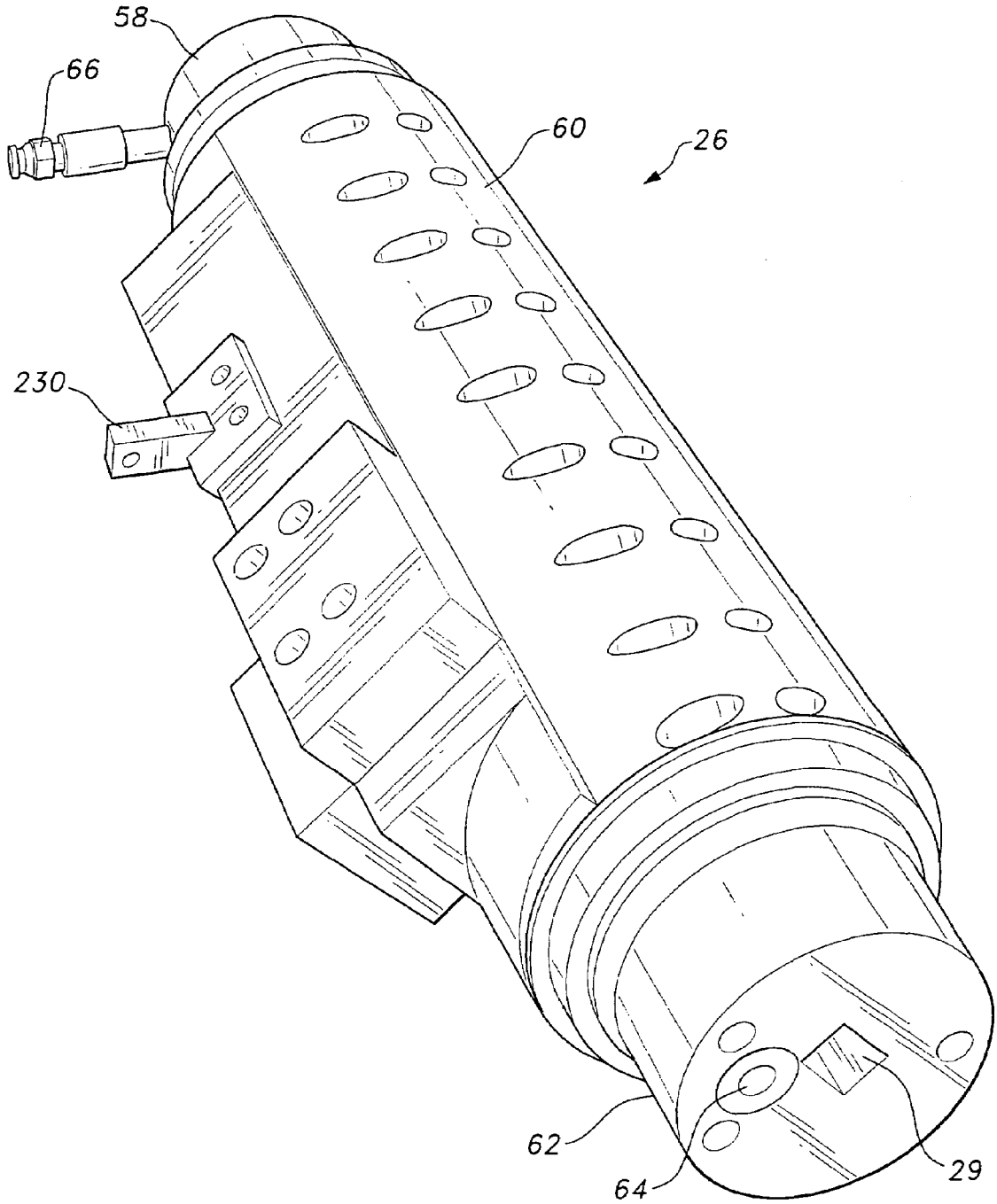
FIG. 4 is a perspective view of a cartridge assembly of the woodworking machine for shaping molding according to the present invention.
Figure 5:
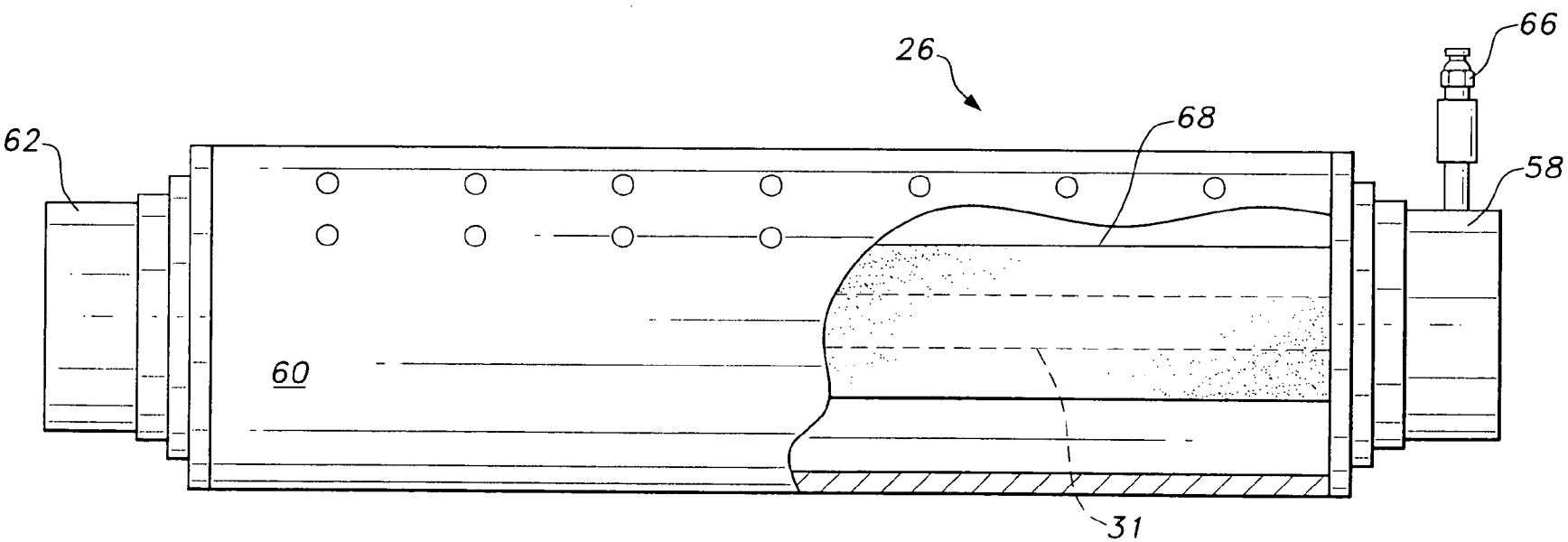
FIG. 5 is a front view of the cartridge assembly of the woodworking machine for shaping molding according to the present invention with the cartridge broken away and partially in section.

As best shown in FIGS. 4 and 5, cartridge assembly 26 is hollow and defines an open inner region 31 therein. The open inner region 31 receives the stock, with an entry opening 27 being formed through one end wall (shown in FIG. 1) of the cartridge in-feed end cap 58, and an exit opening 29 formed through the opposing end wall of the cartridge out-feed end cap 62. The edges of the entry opening 27 are chamfered or beveled in order to facilitate pushing the molding blank into the cartridge assembly 26. At step 410, upon the feeding of the wooden work piece within cartridge 26, the insertion of the workpiece may be controlled by a separate user-programmable and actuatable shuttle beam controller 311, which is in communication with main controller 310 (shown in FIG. 10).

In the preferred embodiment, the initial workpiece stock has a substantially rectangular cross-sectional contour, and the dental molding (such as the exemplary dental molding 100) also has a substantially rectangular cross-sectional contour. Thus, entry opening 27 and exit opening 29, in the preferred embodiment, each have a substantially rectangular contour. However, it should be understood that openings 27, 29 may have any desired cross-sectional contour.

The cartridge assembly 26 includes a main cylindrical body 60, which is preferably formed from plastic or the like. As shown in FIG. 5, an air bag 68 is mounted within the cylindrical body 60 and is positioned within region 31 (the phantom or dashed lines in FIG. 5 are not meant to imply that the feedstock is behind or within air bag 68, but merely indicate the relative location on the exterior of the air bag 68 where the feedstock is located, the air bag 68 being behind the feedstock and supporting the feedstock as the notches are cut). When the stock is fed into region 31, the air bag 68 is inflated by compressed air to support and position the workpiece stock (step 420). By varying the pressure of air within air bag 68, the stock may be moved, under external control, in both the horizontal and vertical directions, within region 31 during the cutting process. The inflation and deflation of air bag 68 is controlled by PLC 310.

An inlet port 66 is formed on cartridge in-feed end cap 58 for connection with an air compressor. The inlet port 66 is in communication with air bag 68 for the inflation thereof. A vacuum pump is further in communication with air bag 68 for the controlled deflation thereof, following the completion of a cutting cycle. An air bag end plug 64 is shown formed in the cartridge out-feed end cap 62, as shown in FIG. 4.

Figure 2:
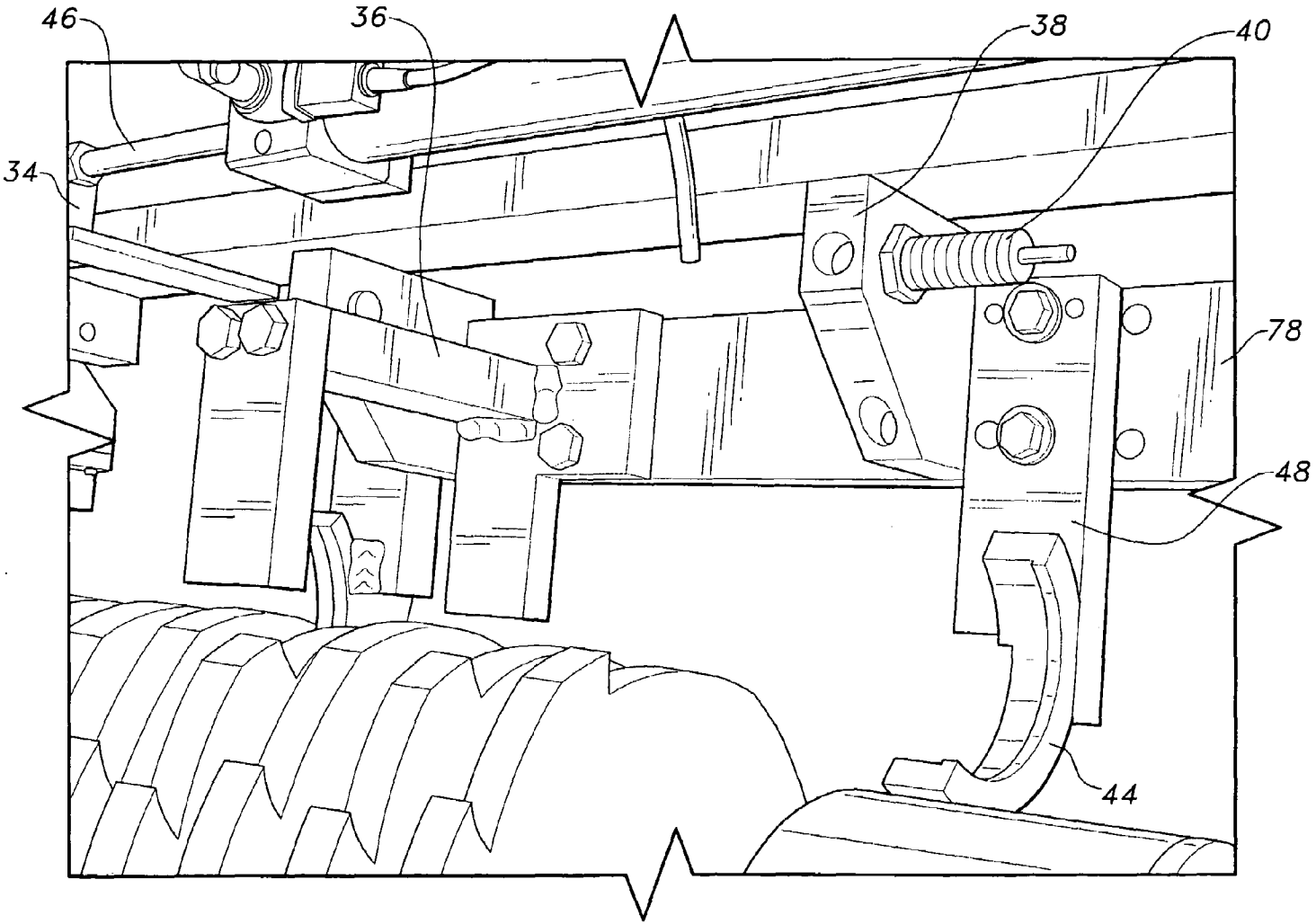
FIG. 2 is a partial perspective view of the woodworking machine for shaping molding according to the present invention with the cartridge removed.
Figure 6:
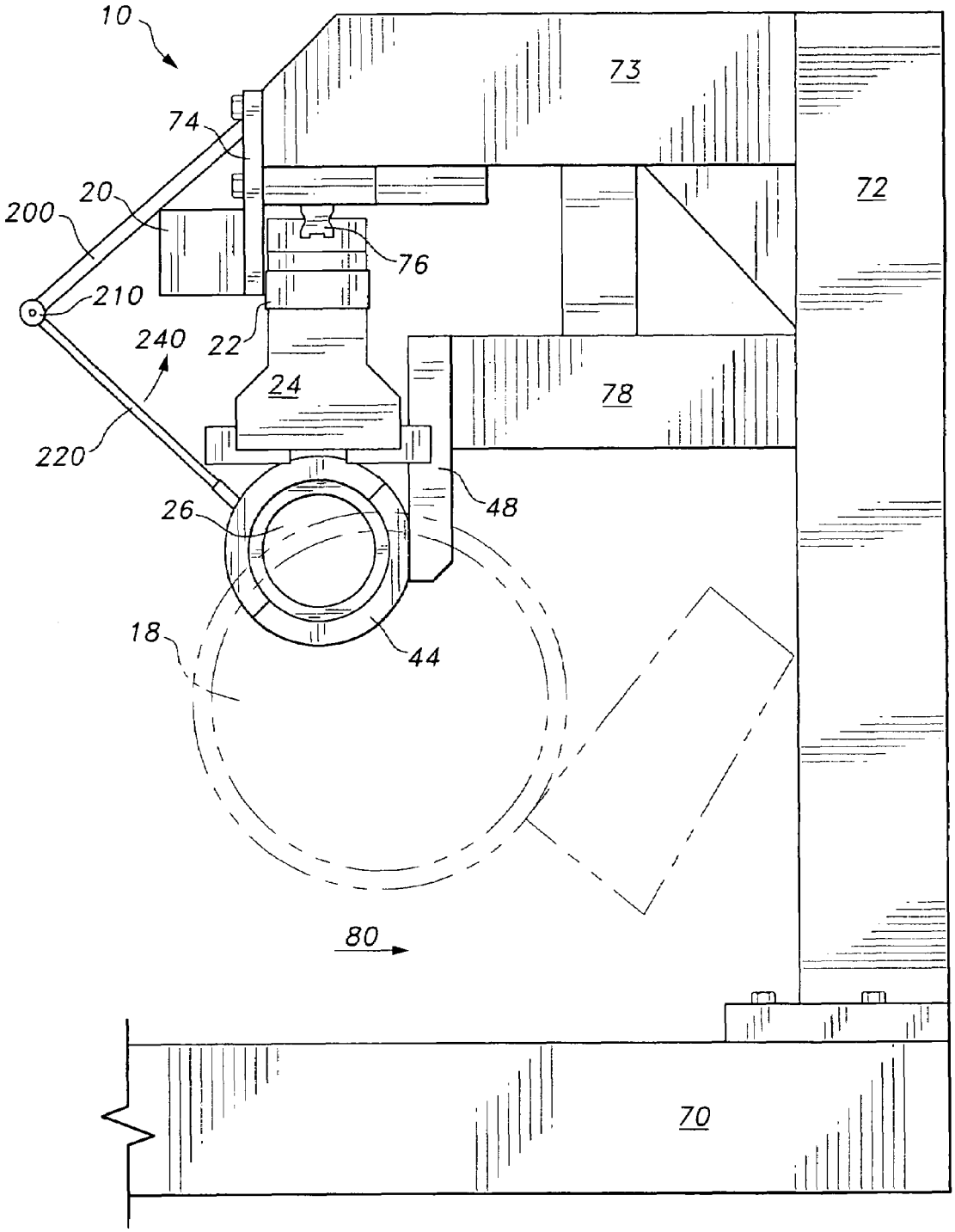
FIG. 6 is a partial side view of the woodworking machine for shaping molding according to the present invention.
Figure 7:
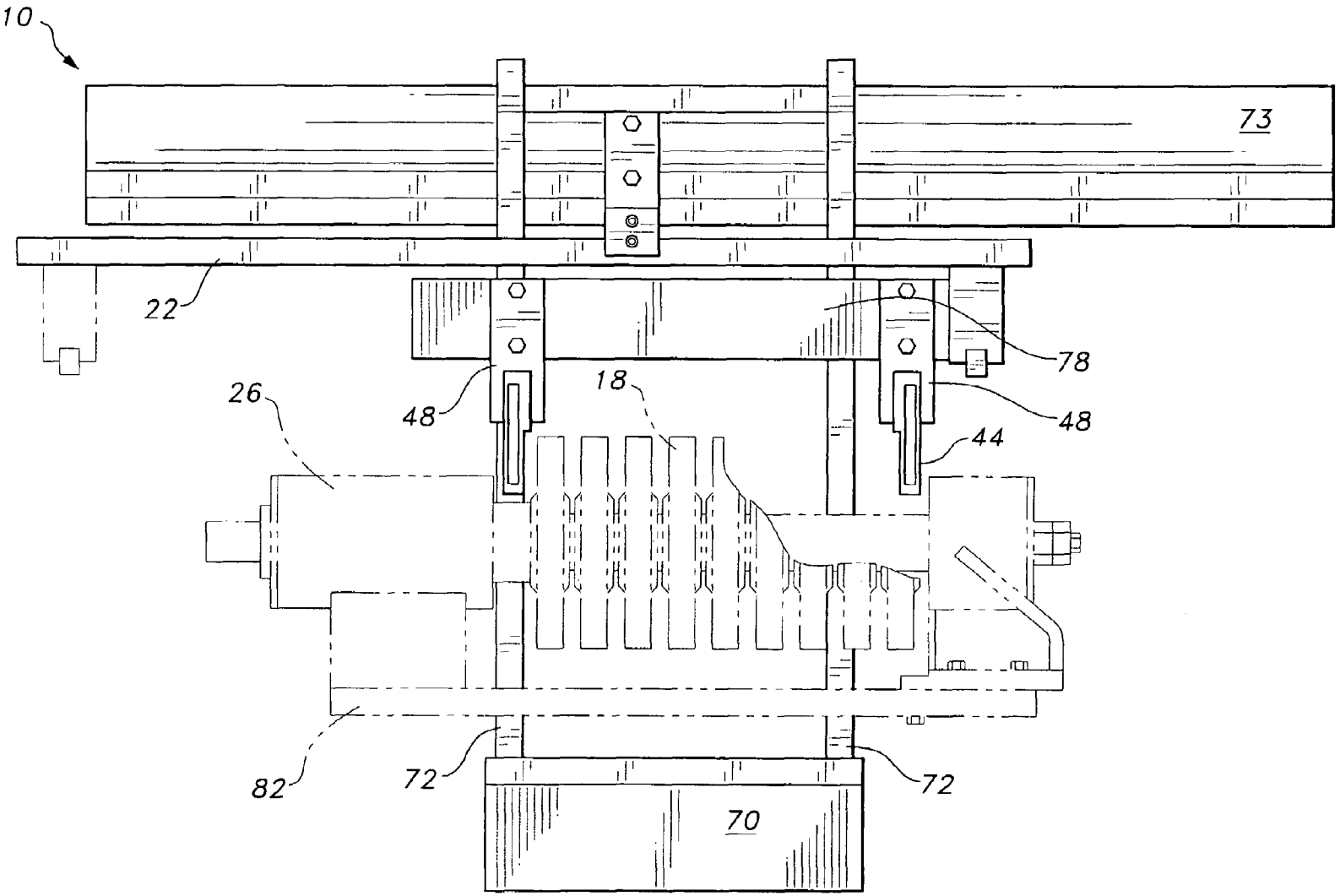
FIG. 7 is a partial front view of the woodworking machine for shaping a molding according to the present invention.
Figure 8:
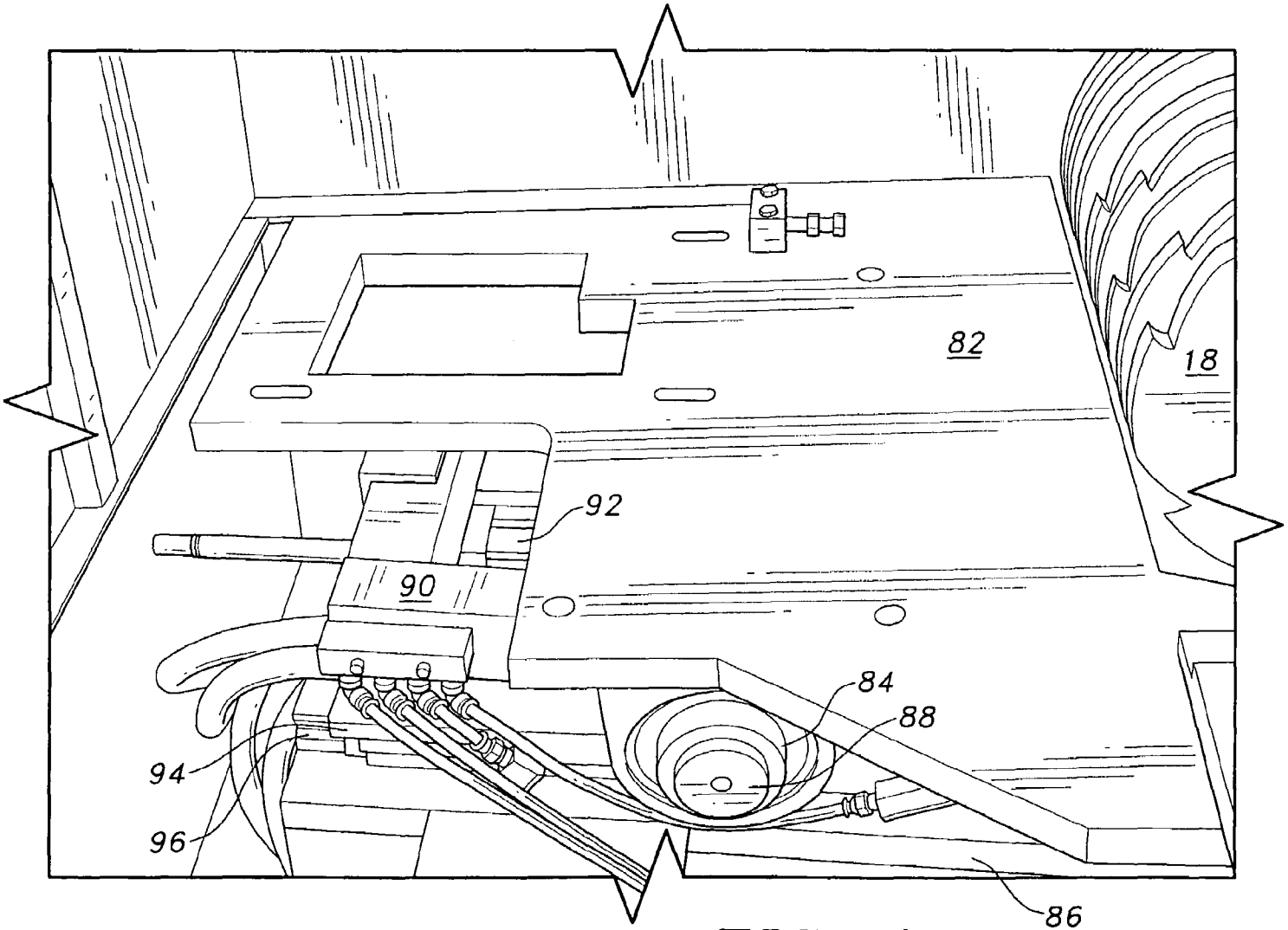
FIG. 8 is a partial perspective view of the woodworking machine for shaping a molding according to the present invention showing the movable table thereof.

As best shown in FIGS. 6 and 7, the cartridge assembly 26 is mounted in a cartridge holder bracket 44. The cartridge assembly 26 is removable and replaceable, a different cartridge being used for each size of blank molding. During the cutting process, the cartridge assembly 26 is also cut (as will be described below), and used cartridges may be removed from brackets 44 and replaced with new cartridge assemblies 26. Cartridge holder brackets 44 are supported by a horizontal support beam 78, mounted to a rear support 72 of machine 10. FIG. 2 illustrates the cartridge holder brackets 44 with cartridge assembly 26 removed from machine 10.

Figure 1:
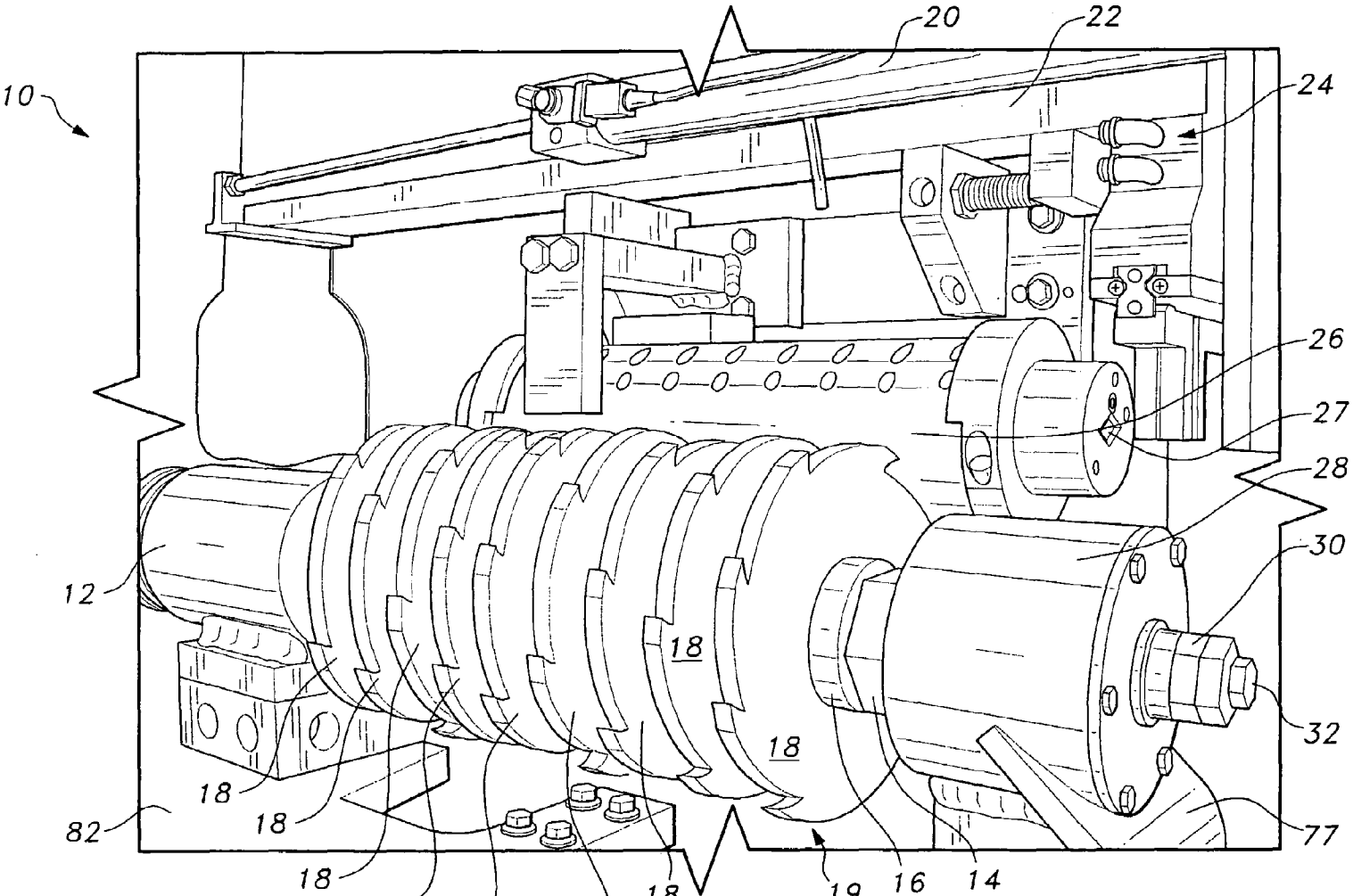
FIG. 1 is a partial perspective view of a woodworking machine for shaping molding according to the present invention.

As shown in FIG. 1, a cutter assembly 19, which includes an array of cutters 18 mounted on a central spindle, is mounted between a spindle headstock assembly 12 and a removable tail stock assembly 28. It should be understood that in FIG. 1 the cutters 18 are shown diagrammatically as substantially circular toothed blades. In practice, each cutter 18 preferably comprises a disk-shaped cutterhead having a plurality of inserts mounted about its periphery, the inserts having a blade, preferably a carbide-tipped blade, mounted therein, the cutter insert being clamped to the cutterhead. The blade made be any blade or knife adapted for cutting notches in the molding stock, and may include side spurs on both sides of the cutterhead to clip the wood grain ahead of the main cutting blades. Alternatively, cutters 18 may comprise a dedicated, one-piece cutter. As used herein, the term cutter assembly 19 refers to the combination of the spindle, a plurality or array of cutters 18, and, as will be described below, cutter spacers. Any suitable number of cutters 18 may be mounted on the spindle to form cutter assembly 19, although in the preferred embodiment, approximately nine cutters 18 are used.

Cutters 18 are spaced apart by a plurality of cutter spacers 16. The spacing of the cutters 18 is user adjustable and selectable, depending upon the size of the teeth 110 and notches 120 of the dental molding 100. Although cutter assembly 19 is shown having nine cutters 18 for simultaneously cutting nine notches to form eight teeth, the cutter assembly 19 may have any desired number of cutters 18. Rather than cutting the stock directly to form notches 120 of dental molding 100, the cutters 18 cut into cartridge assembly 26 and through the plastic main body 60, which holds the stock therein. The cutter assembly 19 is driven by a spindle motor 320, in communication with PLC 310. Once the stock has been fed into cartridge assembly 26 (step 410), the air bag 68 is inflated (step 420) to secure the stock therein, and the cutter assembly 19 is driven to cut into the cartridge assembly 26 and the stock (step 430).

If cutters 18 were to cut only the workpiece stock, splintering or other damage of the unsupported stock might occur. The cutting of both the plastic main body 60 and the wood stock provides protection, support and shielding for the wood stock during the cutting process. During the cutting process, gouges or grooves are cut into the plastic main body 60. As noted above, used cartridge assemblies 26 may be removed and replaced with new, uncut cartridge assemblies 26.

During the cutting process, the workpiece stock is moved along the longitudinal axis of the cartridge assembly 26 through interior region 31 by the gripping mechanisms 24. The first gripping mechanism 24 inserts the stock into cartridge assembly 26, and a second gripping mechanism 24, as noted above, positioned on the opposite end of cartridge assembly 26, removes the cut molding 100 from the opposite end of the cartridge 26. Cartridge assembly 26 is further rotated, under external control, by a pneumatic arm 220 (shown in FIG. 6), which is joined at one end to the pneumatic connector member or bracket 230 (shown in FIG. 4) of the cartridge assembly 26.

Cartridge assembly 26 is first held in an initial position while gaps 120 are cut in the horizontal direction. Cartridge assembly 26 is then rotated by approximately 90° so that the cutters 18 may continue cutting the gaps 120 in a vertical direction (step 440). As will be described in greater detail below, at this stage, upon actuation of system 10, a movable tilt table 82 (upon which the spindle is mounted), is raised to an elevated position, and remains in this position until the end of the cutting cycle, although the exact functioning of the movable tilt table 82 is preferably programmable, and user-selectable and adjustable.

The wooden workpiece is positioned within cartridge 26 so that when the cartridge 26 undergoes the 90° rotation, the cutting blades remain at the correct depth within the wood. Further, the other end of pneumatic arm 220 is pivotally joined by a pivot pin 210 or the like to an angled support 200 secured to upper wall 73. Under external pneumatic control (via communication with PLC 310), pneumatic arm 220 rotates (as indicated by directional arrow 240) about support 200, thus causing controlled rotation of cartridge assembly 26 during the cutting process. It should be understood that the user may choose not to rotate the cartridge assembly 26 during the woodworking process. The rotation of the cartridge assembly 26 creates a dental molding having notches formed in two orthogonal faces of the workpiece. The user may choose to create a dental molding having notches formed in only a single face of the workpiece, and may therefore choose to eliminate the rotation of cartridge assembly 26.

In addition to the rotation of the cartridge assembly 26, the cutters 18 are moved in the horizontal direction (indicated by directional arrow 80 in FIG. 6), to cut into the cartridge assembly 26 and the workpiece. The spindle headstock assembly 12 and the removable tail stock assembly 28 are mounted on a movable table 82 (shown in FIG. 8). Under external control by PLC 310, movable table 82 moves in the horizontal direction under hydraulic drive, through the use of a hydraulic cylinder 92 or the like, or through the application of any suitable user-controllable drive means.

Table 82 is mounted on linear bearings 94, which are supported by rails 96. Table 82 is further mounted on a carriage weldment 90 of the movable carriage, with the entire assembly being mounted on a machine base 86. In addition to horizontal movement, the table 82 may alternatively rotate about a table pivot shaft 88, which may further include table tilt bearings 84. In the preferred embodiment, the hydraulic drive moves the cutter assembly 19 and associated drive motor approximately six inches, and is supported on a pair of rails 96. Cutter assembly 19 may be contained within a dust shield, preferably connected to a vacuum source, to protect the cutters 18, the drive source, and the external environment from saw dust created during the woodworking process.

Following the cutting process, the cutter assembly 19 (and the table upon which the assembly 19 is mounted) is retracted (step 450), and the cartridge assembly 26 is rotated back to its initial angular position (step 460). The air bag 68 is deflated by a vacuum pump or the like (step 470), under control of the PLC 310, and the molding 100 is advanced by an incremental length to repeat the cycle, or the completed molding is expelled and removed (step 480) from exit opening 29 (via the second gripping mechanism) and a new, uncut workpiece may be fed into opening 27 by the first gripping mechanism 24 to begin the process again for formation of another dental molding 100 (indicated by arrow 490 in FIG. 11).

As shown in FIGS. 6 and 7, the machine 10 includes a base 70, adapted for mounting on a suitable support surface, such as the floor. A rear support 72 is joined to a rear edge of base 70 and extends upwardly therefrom. Upper wall 73 is mounted on an upper end of rear support 72 and projects forwardly therefrom. Base 70, rear support 72 and upper wall 73 may be formed from metal or any other suitable structurally strong material. A mounting plate 74 is fixedly secured to a front edge of upper wall 73 and both the fixed end of angled support 200 (as described above) and pneumatic cylinder 20 (best shown in FIG. 1) are mounted thereto.

Shuttle rail 76 is mounted to a lower edge of upper wall 73 and supports shuttle beam 22, upon which the robotic grippers 24 are slidably mounted. Further, a horizontal support 78 is mounted to a front edge of rear support 72 and projects forwardly therefrom. A pair of vertical support members 48 are mounted to horizontal support 78, and the cartridge holder brackets 44 (described above) are mounted to the vertical support members 48.

As best shown in FIG. 1, the plurality of rotary cutters 18 are mounted between spindle headstock assembly 12 and removable tail stock assembly 28. The removable tail stock assembly 28 is removable from the spindle and from table 82, allowing the cutters 18 to be replaced and/or have the number or spacing of the cutters 18 adjusted. The spindle and cutters 18 are releasably held to tail stock assembly 28 by collar 30 and bolt 32, which may be removed by the user. Each cutter 18 is separated from the adjacent cutters 18 by a cutter spacer 16, and the cutter spacer 16 adjacent the removable tail stock assembly 28 is spaced apart therefrom by a spindle nut 14. Spindle nut 14, which may be adjustably tightened by the user, maintains the cutters 18 in proper alignment with one another and, through loosening thereof, aids in the removal of tail stock assembly 28.

As best illustrated in FIG. 2, each cartridge holder bracket 44 preferably has a substantially C-shaped contour for receiving and releasably holding the cartridge assembly 26 therein. The cartridge assembly 26 is further maintained in proper alignment by cartridge bracket assembly 36, as shown. Cartridge bracket assembly 36 includes a horizontal support and a pair of cartridge index supports projecting downwardly therefrom, as shown, with the cartridge assembly 26 being received therebetween. With the exemplary nine cutters 18 of cutter assembly 19, shown in FIG. 1, the cartridge assembly 26 is indexed to cut approximately between twelve and fourteen inches per cutting cycle and advance the appropriately indexed segment of the stock workpiece for the next cutting cycle.

Pneumatic cylinder 20, which provides pneumatic drive power for movement of gripping mechanism 24 on shuttle beam 22, is mounted to bracket 74, which, in turn, is mounted to upper wall 73 (as best shown in FIG. 6). The associated rod of pneumatic cylinder 20 is supported by cylinder rod brackets 34, which are mounted on the shuttle beam 22. It should be noted that in the preferred embodiment, the robotic grippers 56 have a pneumatic piston driven by a separate air supply for actuation of the jaws to grip the workpiece between the jaws. As best shown in FIG. 2, a hydraulic cushion bracket 38 is mounted to horizontal support 78 and projects outwardly therefrom for supporting a hydraulic cushion 40, which acts to stabilize and maintain alignment of the gripper mechanism 24.

Figure 3:
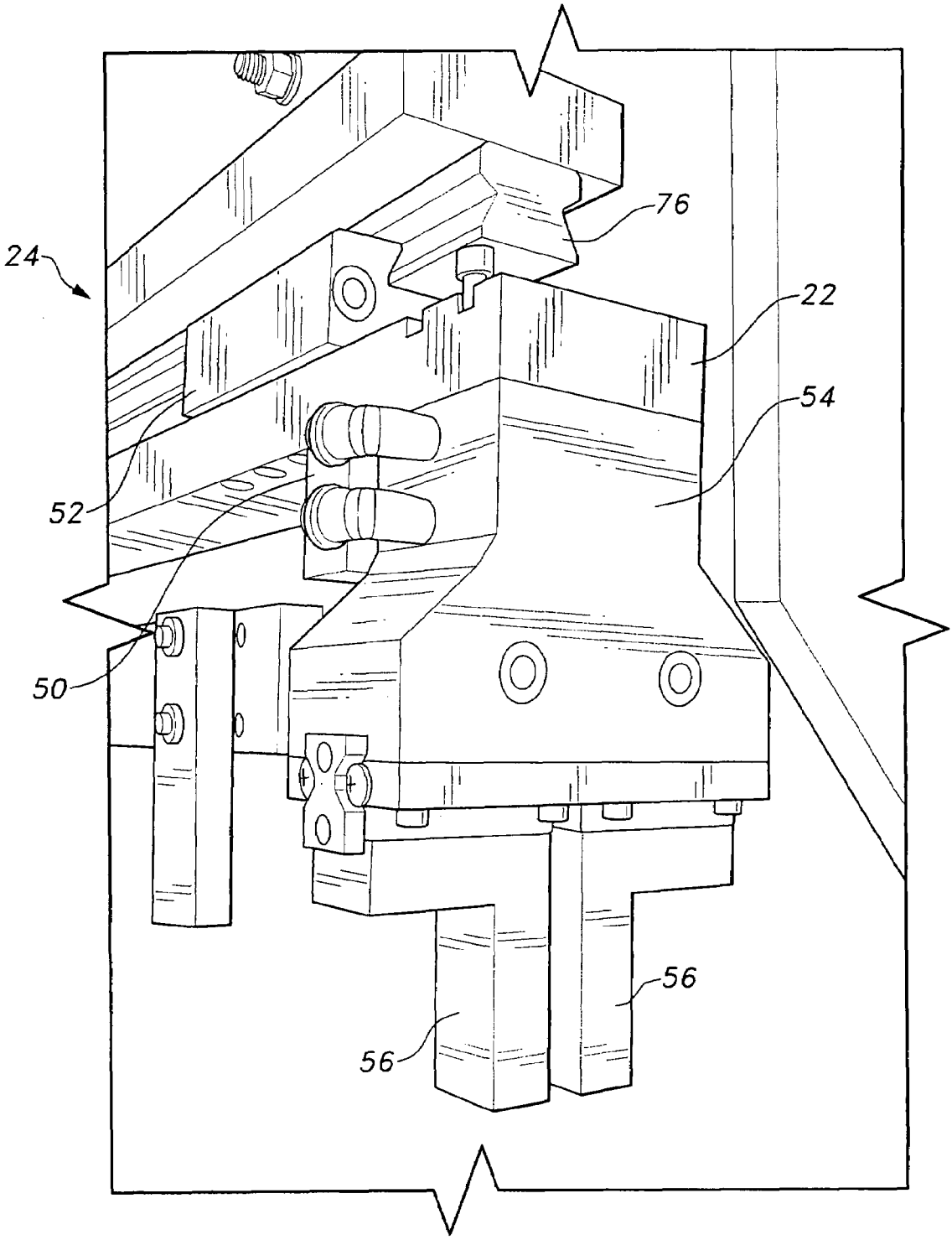
FIG. 3 is a partial perspective view of the woodworking machine for shaping molding according to the present invention showing details of one of the robotic grippers.

As shown in FIG. 3, the first robotic gripper mechanism 24 includes a main body portion 54 with a pair of adjustable gripping arms 56 mounted to a lower surface thereof. Under external control (via communication with PLC 310), gripping arms 56 move in the lateral direction to grasp and release the elongated blank molding strip for cutting thereof. At least one shuttle beam stop block 50 is mounted to the lower surface of shuttle beam 22 and projects downwardly therefrom for stopping the gripping assembly 24 from moving beyond a predetermined position. The shuttle beam stop block 50 contacts the hydraulic cushion 40 of FIG. 2. It should be understood that any suitable user-controlled gripping mechanism may be utilized in machine 10. Further, in the preferred embodiment, a pair of stop blocks 50 are provided, one allowing for extension and one for retraction. Similarly, in the preferred embodiment, a pair of hydraulic cushions 40 are provided, one being associated with a respective one of stop blocks 50. It should be understood that in the simplified FIG. 3, bracket 44 is not shown. The bracket 44, clearly shown in FIG. 2, has been removed in FIG. 3 only for illustrative and simplification purposes.

A pair of shuttle linear bearings 52 are provided and are mounted on the upper surface of shuttle beam 22, as shown. The shuttle linear bearings 52 slidably receive the shuttle rail 76. The movement of the robotic gripping mechanisms 24 on the shuttle beam 22 allows for the controlled feeding and removal of the stock and produced molding into and through the cartridge assembly 26 during the cutting process.

If the programmable logic controller 310 is programmed to move the table 82 and the cutter assembly 19 to the proper distance, the notches 120 may be formed with a radius cut in the sides of the teeth 110. It should be understood that, through the use of user-selectable and programmable controller 310, the cutter assembly 19 may be positioned to form any suitable variation of the exemplary dental molding, such as those described above or, for example, the further formation of a rounded or radial, cut of the inner corners of notches 120. It should be understood that through the user-controlled rotation of the cartridge during the cutting process, the user may control the degree of the radial cut in the dental molding, particularly through the controlled alignment and orientation of the cutting head with respect to the cartridge. The radial cut is generated, or performed, as the cartridge rotates while the cutter blades simultaneously engage the cartridge and workpiece.

It is to be understood that the present invention is not limited to the embodiments described above, but encompasses any and all embodiments within the scope of the following claims.

I claim:

1. A woodworking machine for shaping a molding, comprising:

a frame;

a shuttle mounted on the frame;

a spaced apart pair of robotic grippers mounted on the shuttle, the grippers being adapted for gripping and releasing an elongated blank strip of molding;

a hollow, cylindrical cartridge having opposing end caps, the end caps having openings defined therein dimensioned and configured for supporting the blank strip of molding when the molding is inserted through the cartridge, the cartridge being rotatably mounted on the frame;

a table mounted on the frame, the table being movable both vertically and laterally relative to the cartridge;

a cutter assembly having a plurality of cutters, the cutter assembly being mounted on the table, the table and cutter assembly being movable so that the cutters are positioned to cut through the cartridge and the blank strip of molding when the molding is inserted through the cartridge; and an electronic control system having means for cyclically actuating the robotic grippers to grip the blank strip of molding, move the shuttle and robotic grippers to advance the molding through the cartridge in indexed increments, actuate the cutter assembly to rotate the cutters, move the table and cutter assembly so that the cutters engage the cartridge and the blank strip of molding within the cartridge to form simultaneous, spaced apart cuts in the blank strip, retract the table and cutter assembly from the cartridge, and repeat the cycle.

2. The woodworking machine as recited in claim 1, further comprising a user interface in electrical communication with said electronic control system.

3. The woodworking machine as recited in claim 1, further comprising a spindle motor for driving the plurality of cutters, the spindle motor being in electrical communication with said electronic control system.

4. The woodworking machine as recited in claim 1, further comprising a pneumatic drive system mounted to said shuttle for driving said spaced apart pair of robotic grippers, the pneumatic drive system being in electrical communication with said electronic control system.

5. The woodworking machine as recited in claim 1, wherein the openings formed through the end caps of the hollow, cylindrical cartridge define an entry opening and an exit opening, the walls of the end cap defining the entry opening being beveled.

6. The woodworking machine as recited in claim 1, further comprising an air bag disposed within said hollow, cylindrical cartridge for releasably securing the blank strip of molding therein.

7. The woodworking machine as recited in claim 6, further comprising means for selectively inflating and deflating the air bag, the means being in electrical communication with said electronic control system.

8. The woodworking machine as recited in claim 7, wherein the means for selectively inflating and deflating the air bag comprises an air compressor and a vacuum pump.

9. The woodworking machine as recited in claim 8, wherein an inlet port is formed through a housing of said hollow, cylindrical cartridge, the inlet port being in fluid communication with the air bag, the air compressor and the vacuum pump.

10. The woodworking machine as recited in claim 1, further comprising a cartridge holder bracket mounted on said frame for releasably and rotatably supporting said cartridge.

11. The woodworking machine as recited in claim 1, wherein spacing between adjacent ones of the plurality of cutters is user-selectable and adjustable.

12. The woodworking machine as recited in claim 1, wherein said cartridge is formed from plastic.

13. The woodworking machine as recited in claim 1, further comprising a pair of spaced apart secondary grippers mounted on said shuttle, said spaced apart pair of robotic grippers and the pair of spaced apart secondary grippers being positioned adjacent opposite ends of said hollow, cylindrical cartridge, the pair of spaced apart secondary grippers being adapted for removing the molding from the hollow, cylindrical cartridge.

14. The woodworking machine as recited in claim 1, further comprising a pneumatic arm mounted to said frame, the pneumatic arm driving rotation of said cartridge.

15. The woodworking machine as recited in claim 14, further comprising means for selectively driving the pneumatic arm, the means being in electrical communication with said electronic control system.

16. The woodworking machine as recited in claim 15, further comprising a pneumatic connector bracket attached to said cartridge and a proximal end of the pneumatic arm, the pneumatic connector bracket joining said cartridge to the proximal end of the pneumatic arm.

17. The woodworking machine as recited in claim 1, further comprising means for selectively driving movement of said table, the driving means being in electrical communication with said electronic control system.

18. The woodworking machine as recited in claim 17, wherein the means for selectively driving movement of said table comprises a hydraulic drive system.

19. The woodworking machine as recited in claim 1, wherein said cutter assembly further comprises:

a spindle, the plurality of cutters being mounted on the spindle;

a headstock assembly; and a tailstock assembly, the spindle having opposite ends mounted to the headstock and tailstock assemblies, respectively, the plurality of cutters being positioned therebetween.

20. The woodworking machine as recited in claim 1, further comprising a hydraulic cushion mounted to said frame for stabilizing and aligning said spaced apart pair of robotic grippers.

* * * * *